US005155530A

United States Patent [19]

Larson et al.

[11] Patent Number: 5,155,530

[45] Date of Patent: Oct. 13, 1992

[54] TONER PROCESS CONTROL SYSTEM BASED ON TONER DEVELOPED MASS, REFLECTANCE DENSITY AND GLOSS

[75] Inventors: James R. Larson, Fairport; Jon R. Swanson, Rensselaer, both of N.Y.

[73] Assignee: Xerox Corporation, Stamford, Conn.

[21] Appl. No.: 815,223

[22] Filed: Dec. 31, 1991

[51] Int. Cl.[5] ..... G03G 15/00

[52] U.S. Cl. ..... 355/208; 355/246

[58] Field of Search ..... 355/208, 246, 265, 282, 355/256

[56] References Cited

U.S. PATENT DOCUMENTS

| | | | |
|---|---|---|---|
| 4,179,213 | 12/1979 | Queener . | |
| 4,277,162 | 7/1981 | Kasahara et al. | 355/208 |
| 4,312,589 | 1/1982 | Brannan et al. . | |
| 4,377,338 | 3/1983 | Ernst . | |
| 4,466,731 | 8/1984 | Champion et al. . | |
| 4,551,004 | 11/1985 | Paraskevopoulos . | |
| 4,572,654 | 2/1986 | Murai et al. . | |
| 4,829,336 | 5/1989 | Champion et al. . | |
| 5,053,307 | 10/1991 | Houle et al. | 430/137 |

*Primary Examiner*—Joan H. Pendegrass
*Attorney, Agent, or Firm*—Oliff & Berridge

[57] ABSTRACT

A method for controlling toner developed mass per unit area in an electrostatic or electrophotographic device includes the steps of: forming a toner image on a printing sheet; measuring a toner density of the toner image on the printing sheet; measuring a gloss of the toner image on the printing sheet; determining a toner developed mass per unit area for the measured gloss and measured toner density; and adjusting a voltage of a developement field in the electrostatic device in accordance with the determined toner developed mass per unit area. An apparatus for controlling toner developed mass per unit area in an electrostatic device includes: means for fusing a toner image onto a printing sheet; means for measuring a toner density of toner particles on the fused toner image; means for measuring a gloss of the fused toner image on the printing sheet; means for determining toner developed mass per unit area for the measured gloss and measured toner density; and means for adjusting a voltage of a development field in a range in which the toner developed mass per unit area and the voltage of the development field are related so that an increase in the voltage leads to an increase in the toner developed mass per unit area, and a decrease in the voltage leads to a decrease in the toner developed mass per unit area.

13 Claims, 3 Drawing Sheets

TONER PROCESS CONTROL SYSTEM BASED ON TONER DEVELOPED MASS, REFLECTANCE DENSITY AND GLOSS

BACKGROUND OF THE INVENTION

1. Field of the Invention

This invention relates to improvements in methods and apparatus for electrostatic image development and, more particularly, to controlling toner developed mass in an electrophotographic apparatus and electrostatic printing apparatus.

2. Background

For proper understanding of the invention and the disclosure, the following basic definitions are provided.

A "print sheet" is a paper which has been fused with a toner image in an electrostatic device.

DMA is an abbreviation for developed toner mass per unit area of toner on a print sheet, and is usually given in the units of $mg/cm^2$. DMA refers to the actual amount of toner solids per unit area of paper.

Gloss is a measure of an image's shininess which should be measured after a toner image has been fused onto a print sheet, since the fusing process alters the gloss. It is defined at a specular angle, which is the angle between the perpendicular to a surface and the reflected ray that is numerically equal to the angle of incidence and that lies in the same plane as the incident ray and the perpendicular but opposite to the incident ray. The choice of a specular angle for desired gloss characteristics is determined by the nature of the substrate. The specular angle is usually increased as the substrate gloss decreases. Thus, for low to medium gloss substrates, best results are obtained with relatively high specular angles.

Image reflectance density (hereinafter "density") corresponds to color strength in that more intense color appears denser. Density is measured using a reflection densitometer whereupon image gloss reduces the amount of light that reaches the detector of the densitometer. The densitometer interprets the reduction of light as increased absorption of incident light and thus higher color density. When all other factors are equal, glossier images appear denser. Thus, comparing density values when gloss is changing can cause erroneous results.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated areas, to record an electrostatic latent image on the photoconductive member corresponding to the informational areas contained within the original document. After the electrostatic latent image is recorded on the photoconductive member, the latent image is developed by bringing a developer material into contact therewith. The development field, which causes image development, is the electric field between the image charge and a development electrode that is grounded or electrically biased. Two types of developer materials are typically employed in electrophotographic reproducing machines. One type of developer material is known as a dry developer material and comprises carrier granules having toner particles adhering triboelectrically thereto. Alternatively, the developer material may be a liquid material comprising a liquid carrier having pigmented particles dispersed therein. In either case, the image recorded on the photoconductive member is developed and transferred to a sheet of support material. Thereafter, the developed image on the sheet of support material is heated to permanently fuse it thereto.

The process control system of a toner imaging device can use a feedback loop to control image reflectance density. Image reflectance density is measured and used to adjust toner development parameters, such as the development field, to obtain a desired reflectance density on subsequent prints and to maintain the toner DMA in a desired range. If the toner DMA is too high then images can become smeared in subsequent steps and if DMA is too low fine image features can remain undeveloped. However, reflectance density is often not a direct function of development field and in some cases when image gloss is uncontrolled, reflectance density can decrease with an increasing development field and vice versa. An improved process control system would measure and use toner DMA to adjust toner development parameters since toner DMA is directly related to development field over a broad range of development fields. However, a problem arises in that toner developed mass is difficult to measured directly in an imaging device.

The prior art does not recognize the problem that the development field of an electrostatic imaging device can be adjusted by determining the toner developed mass per unit area as related to a combination of reflectance density and image gloss. In the past, reflectance density has been measured by densitometers to provide a means for toner concentration control. However, no process control system in an electrostatic device has utilized or suggested the process of measuring both reflectance density and gloss to adjust a development field using a toner developed mass which is functionally related to both reflectance density and image gloss. The above problems in the prior art are prevalent in electrostatic devices which use either liquid toner or toner powder.

3. Description of the Related Art

The following references demonstrate the teachings of the prior art, but none of the references recognizes the effect of the image gloss on the toner density requirements.

U.S Pat. No. 4,551,004 to Paraskevopoulos describes an apparatus for monitoring toner concentration on a photoreceptor surface by optically sensing the amount of toner that is triboelectrically attracted to a portion of the photoreceptor surface. The toner sensor of the apparatus acts as a densitometer for determining the density of the toner on the photoreceptor surface. The apparatus includes a light emitting diode, a phototransistor, a beam splitter, and a lens disposed between the beam splitter and the photoreceptor surface to collimate the light beam between the lens and the photoreceptor surface. A portion of the light emitted from the LED is transmitted through the beam splitter and the lens to the photoreceptor surface. Collimated light is reflected from the photoreceptor surface back through the lens and reflected from the beam splitter to the phototransistor. The output signal from the phototransistor is thus independent of the distance of the lens from the photoreceptor surface.

U.S. Pat. No. 4,572,654 to Murai et al describes a method for electrophotographic image density control which controls at least one of various image density parameters in response to detected values of different pattern areas. The image density parameters include an amount of charge deposited on a photoconductive element by a charger, bias voltage for development, toner density in a developer, amount of toner supplied to a developing unit and transfer potential. At least two pattern areas having different potentials are formed on the surface of the photoconductive element by at least one of various means for forming charge patterns which include controlling the energization of the charger, controlling an illuminating lamp and projecting an image pattern. At each of the pattern areas, at least one of the values associated with the image density is detected which includes a surface potential of the pattern area before development, a toner density of the pattern area after development, surface potential of the pattern area after development, and image density of an area of a transferred image which corresponds to the pattern area. The value associated with a predetermined value is compared and matched to one specific pattern area.

U.S. Pat. No. 4,829,336 to Champion et al discloses a patch sensing toner concentration control method and apparatus in which the optical density of reproduction output can be changed without changing the quantity of toner that is deposited on the photoconductor's test patch area. The test patch area receives toner as the patch area passes through a developer station under the influence of a patch development electrical field or vector. Light that is reflected from a bare photoconductor area is compared to light that is reflected from a toned test patch area. The ratio of these two reflected light intensities is used to control the addition of toner to the developer station. Optical density of the reproduction output is changed by changing the toner concentration in the developer station. The toner concentration control method and apparatus of the invention is constructed and arranged to require a fixed or constant ratio of light reflection as an indication of proper toner concentration, independent of the absolute value of toner concentration. Toner concentration, and thereby optical density of reproduction output, is changed by changing the magnitude of the patch development vector, while maintaining the reproduction development vector constant.

U.S. Pat. No. 4,179,213 to Queener describes a method for improving the quality of an electrophotographic image by controlling the toner concentration, the image voltage of the photoconductor, and the bias voltage on the developer. The method pins the value of a white, gray or otherwise colored, single-shaded vector, where the vector represents the value of the image voltage minus the developer voltage. Valuation of changes in the image voltage are obtained by: (1) sensing the reflectivity of a developed single-shaded image and converting that into a representative voltage; (2) sensing the reflectivity of the bare photoconductor and converting that into a representative voltage; (3) obtaining a comparison of the representative image and reference voltages; and (4) noting changes in the comparison. Pinning the vector calls for adjusting the member, for producing the vector (such as the developer voltage or document illumination intensity level), an amount necessary to compensate for the change in the image voltage.

U.S. Pat. No. 4,337,338 to Ernst describes a method and apparatus for copier quality monitoring and control where data correlating to the light reflectance of a maximum toned area and a minimum toned area is recorded to establish measurement standards. A test pattern is imaged onto the photoconductor by controlled illumination levels in a series of steps with the detection of light reflectance from the test pattern being subsequently compared to establish the maximum black and maximum white criteria for storage. Light reflected from cleaned photoconductor areas and subsequently established toner patches then is compared with original test pattern reflectance data to provide a basis for toner replenishment and machine function monitoring.

U.S. Pat. No. 4,312,589 to Brannan et al. describes an electrophotographic copier having a tone concentration control apparatus which periodically measures, by light reflectance, the optical density of toner deposited on a photoconductor test area. As the results of the toner patch test cycle indicate lower than acceptable toner density, as by high light reflectance off the test patch, the photoconductor's charge magnitude is periodically increased until a working charge magnitude is reached. The results of the toner patch test cycle are operable to add toner to the copier's developer only when the photoconductor's charge magnitude has been increased to be approximately equal to the working magnitude.

U.S. Pat. No. 4,466,731 to Champion et al. describes an electrophotographic machine and method with high density toner concentration control. A toner concentration control test cycle is run with a test patch produced, preferably in the area of the photoconductor ordinarily used for document reproduction. The optical reflectivity of the developed test area is sensed and the result used to replenish toner if indicated.

SUMMARY OF THE INVENTION

The prior art does not recognize that the image gloss of a particular print sheet, which has been fused with a particular toner image, can effect and alter the amount of toner required for producing an optimum quality print. Furthermore, the prior art does not recognize the relationship described herein between toner density and image gloss and their combined effect upon DMA.

The invention overcomes the above problem by providing a method and apparatus for controlling toner developed mass per unit area in an electrostatic device, comprising the steps of: fusing a toner image on a print sheet; measuring a toner density of the toner image on the print sheet; measuring a gloss of the toner image on the print sheet; determining a toner developed mass per unit area for the measured gloss and measured toner density; and adjusting the development field in the electrostatic device in accordance with the determined toner developed mass per unit area.

An object of the invention is to provide a method for predicting DMA in an electrostatic device in relation to the image gloss and the toner density of a particular print sheet using a particular toner.

Another object of the invention is to control toner DMA in an electrostatic device below a predetermined maximum toner DMA mass to prevent smearing of toner on a low gloss print sheet.

Yet another object of the invention is to control toner DMA in an electrostatic device above a predetermined minimum toner DMA to allow proper imaging of fine features and large areas on a high gloss print sheet.

A further object of the invention is to provide a print sheet of optimum readability and resolution in an electrostatic imaging device.

A yet further object of the invention is to calculate toner DMA using density and gloss measurements on the final print sheet and to use all three parameters, DMA, gloss, and density, to provide a print sheet of optimum readability, resolution, solid area coverage, print density, and print gloss.

The scope of the invention and the manner in which it addresses the problems associated with prior art methods and apparatus will become more readily apparent from the following detailed description when taken in conjunction with the accompanying drawings and claims.

BRIEF DESCRIPTION OF THE DRAWINGS

The invention will be described in detail with reference t o the following drawings in which like reference numerals denote like elements and wherein.

DETAILED DESCRIPTION OF THE PREFERRED EMBODIMENTS

Figure 1:
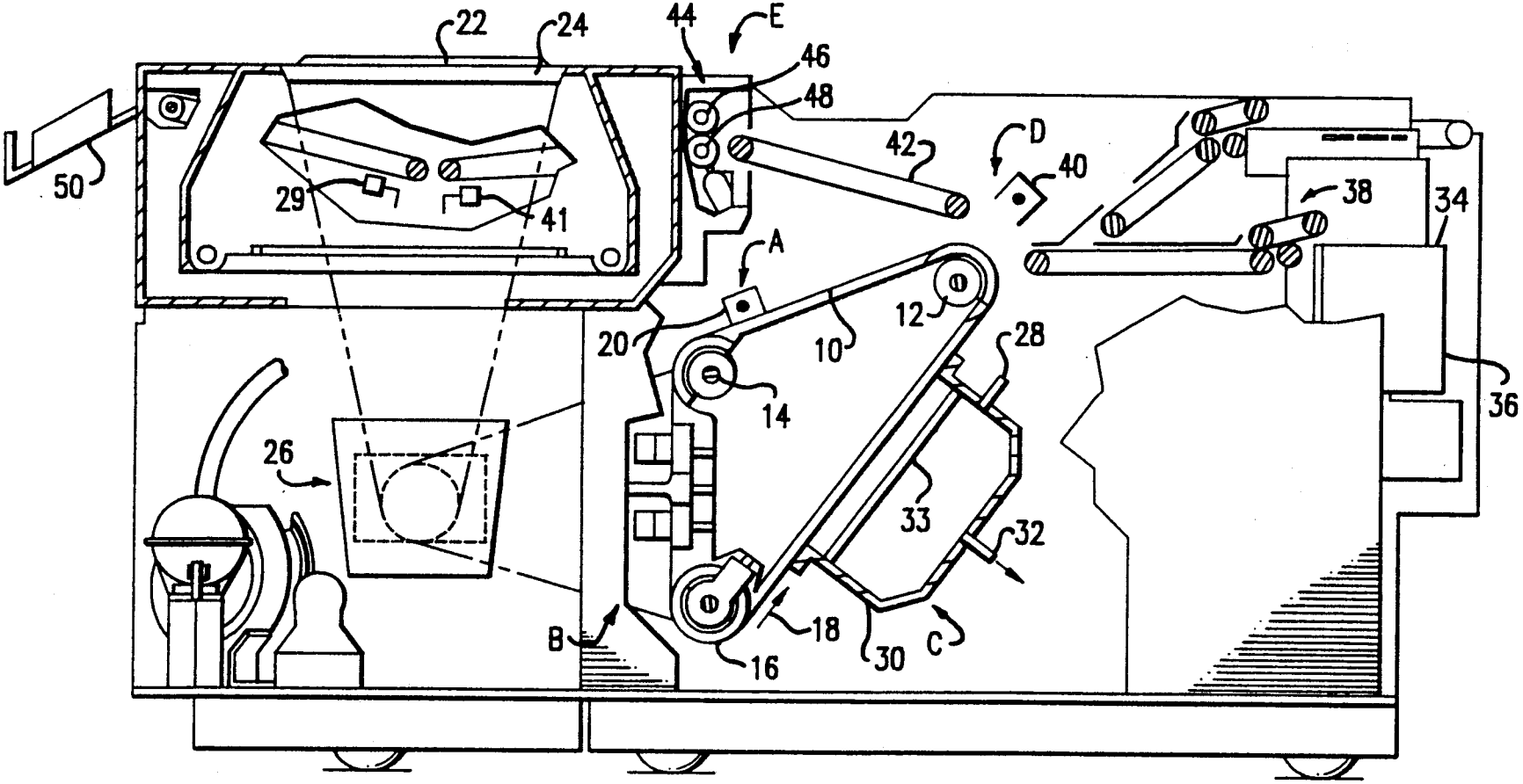
FIG. 1 is a schematic elevational view depicting a first preferred embodiment of an electrophotographic printing machine incorporating the features of the invention therein.

A conventional photocopying machine as well known in the art is described in detail in conjunction with FIG. 1 to illustrate a first preferred embodiment of an electrostatic apparatus according to the invention.

The photocopying machine of FIG. 1 employs a belt 10 having a photoconductive surface deposited on a conductive substrate. Preferably, the photoconductive surface is made from a selenium alloy with the conductive substrate being preferably made from an aluminum alloy which is electrically grounded. Belt 10 advances successive portions of the photoconductive surface sequentially through the various processing stations disposed about the path of movement thereof. The support assembly for belt 10 includes three rollers 12, 14 and 16 located with parallel axes to form the apexes of a substantially triangular belt path. Roller 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof is advanced to exposure station B. At exposure station B, an original document 22 is placed on a transparent support platen 24. An illumination assembly, indicted generally by the reference numeral 26, illuminates the original document 22 on platen 24 to produce image rays corresponding to the informational areas of the original document. The image rays are projected by means of an optical system onto the charged portion of the photoconductive surface. The light image dissipates the charge in selected areas to record an electrostatic latent image on the photoconductive surface which corresponds to the informational areas contained within original document 22. One skilled in the art will appreciate that in lieu of a light lens optical system, a raster output scanner using a modulated laser beam may be used.

After the electrostatic latent image has been recorded on the photoconductive surface of belt 10, belt 10 advances the electrostatic latent image to development station C. At development station C, a developing liquid, comprising at least an insulating carrier liquid and toner particles, i.e., pigmented marking particles, is circulated from any suitable source (not shown) through pipe 28 into a development tray 30 from which it is drawn through pipe 32 for recirculation. Development electrode 33, which may be appropriately electrically biased, assists in depositing toner particles on the electrostatic latent image as it passes in contact with the developing liquid. The charged toner particles, disseminated through the carrier liquid, pass by electrophoresis to the electrostatic latent image. For charge area development, the charge of the toner particles is opposite in polarity to the charge on the photoconductive surface. For example, if the photoconductive surface is made from a selenium alloy, the corona charge will be positive and the particles will be negatively charged. Alternatively, if the photoconductive surface is made from a cadmium sulfide material, the charge will be negative and the toner particles will have a positive charge. Discharge area development, where the charge and the toner particles and the charge on the photoconductive surface are the same, can also be used to obtain high quality images.

A suitable liquid developer material is described in U.S. Pat. No. 4,582,774, issued to Landa in 1986, the relevant portions thereof being hereby incorporated into the present application. A suitable insulating carrier liquid may be made from a aliphatic hydrocarbon, such as Isopars ®, which is a trademark of the Exxon Corporation, having a low boiling point. These are branched chained paraffinic hydrocarbon liquids. The toner particles comprise at least a binder and pigment. The pigment may be carbon black. However, one skilled in the art will appreciate that any suitable liquid developer material, workable in a particular photocopying machine, may be employed.

Belt 10 next advances the electrostatic latent image to transfer station D. At transfer station D, a sheet of support material 34, i.e., copy sheet 34, is advanced from stack 36, by a sheet transport mechanism, indicated generally by the reference numeral 38. Transfer station D also includes a corona generating device 40 which sprays ions onto the backside of the sheet of support material 34. This attracts the developed image from the photoconductive surface of belt 10 to copy sheet 34. The copy sheet then advances from transfer station D to fusing station E. Conveyor belt 42 is adapted to move the sheet of support material, i.e., the copy sheet, to fusing station E.

Fusing station E includes a fuser assembly, indicated generally by the reference numeral 44, which permanently fuses the developed image to the copy sheet. Fuser assembly 44 includes a heated fuser roll 46 and a back-up or pressure roll 48 resiliently urged into engagement therewith to form a nip through which the copy sheet passes. After fusing, the finished copy is discharged to output tray 50 for removal therefrom by the machine operator.

Between fusing station E and output tray 50, the density and the gloss of the toner which has been fused on the copy sheet are measured. The density can be measured using a standard densitometer 29 such as a MacBeth RD 918 manufactured by MacBeth Process Measurements, Newburgh, N.Y. The gloss can be measured using a glossmeter 41 such as a Glossguard II manufactured by Pacific Scientific, Gardner Division, Silver Springs, Md. The gloss and density measurements are communicated to a means for determining developed toner mass per unit area (i.e., a means for determining DMA as shown in FIG. 2).

Figure 2:
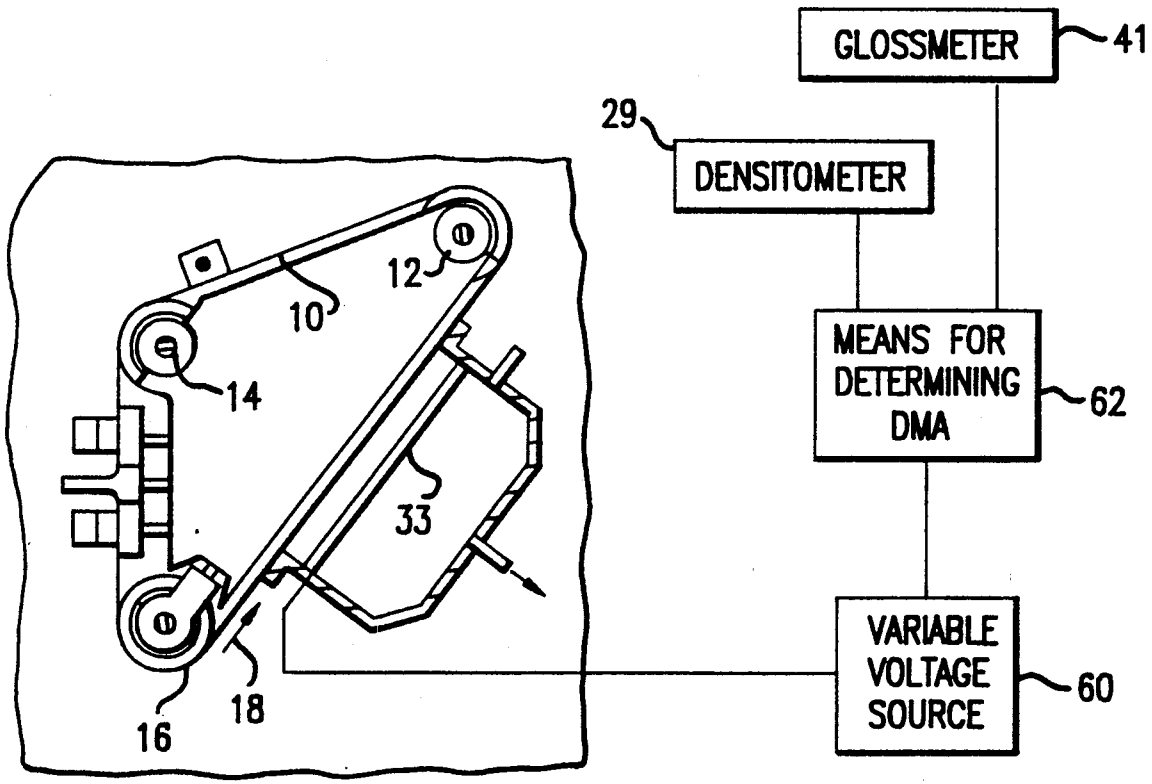
FIG. 2 is a block diagram illustration of control loops in accordance with the invention for the first preferred embodiment of the electrophotographic printing machine of FIG. 1.

FIG. 2 is a block diagram illustration of a partial cutout of the photocopying machine of FIG. 1, showing control loops in accordance with the invention. The figure shows a means 62 for determining DMA, which means 62 receives a toner density measurement from densitometer 29 and a gloss measurement from glossmeter 41, both measurements being taken from a copy sheet fused with a toner image. Next, means 62 retrieves a predetermined look-up table containing the measured gloss and measured toner density of the particular toner, such as shown in Tables 1–4 that will be described later. Typically, the look-up table is provided for a known gloss with a range of workable toner densities. It has been found from the experiments described hereinafter, that a linear regression equation expresses the relationship between DMA, toner density and gloss. Thus, using a fixed gloss and a range of DMA values, the toner densities can be calculated to create a look-up table such as Tables 1–4 for toners C37, M15, Y30 and K27 respectively.

During testing as described hereinafter, the measured values for DMA, toner density and gloss for various toners and papers were statistically analyzed using linear regression to derive a best DMA equation and functional relationship between toner density, gloss and DMA. The importance of the functional relationship rests in the fact that image gloss is being considered as a factor effecting toner density DMA and consequently, effecting the appropriate amount of toner required on a particular electrostatic device for a given toner and copy paper.

During reproduction, a DMA value is produced by measuring the toner density and gloss and then either using the appropriate look-up table for that gloss and toner or the linear regression equation appropriate to the toner. Then a predetermined expected DMA, or DMA range (i.e., an optimum DMA value with a range predetermined within a desirable margin of error), is compared with the DMA derived from the measurements taken by the densitometer and glossmeter. If the derived DMA does not match the expected DMA or does not fall within the expected DMA range, then a variation in the amount of toner is necessary. The optimum DMA value would be that which has been determined, by testing, as that associated with the most desirable visual effect.

The method of using the final print characteristics of gloss and density to calculate developed mass is optimum when all of the toner that is developed is transferred to the final print. As the % transfer efficiency, the ratio of toner mass that is transferred to the final sheet to the toner developed mass times 100, decreases this method will become less accurate.

% Transfer Efficiency = (transferred toner mass/developed toner mass) 100

Figure 3:
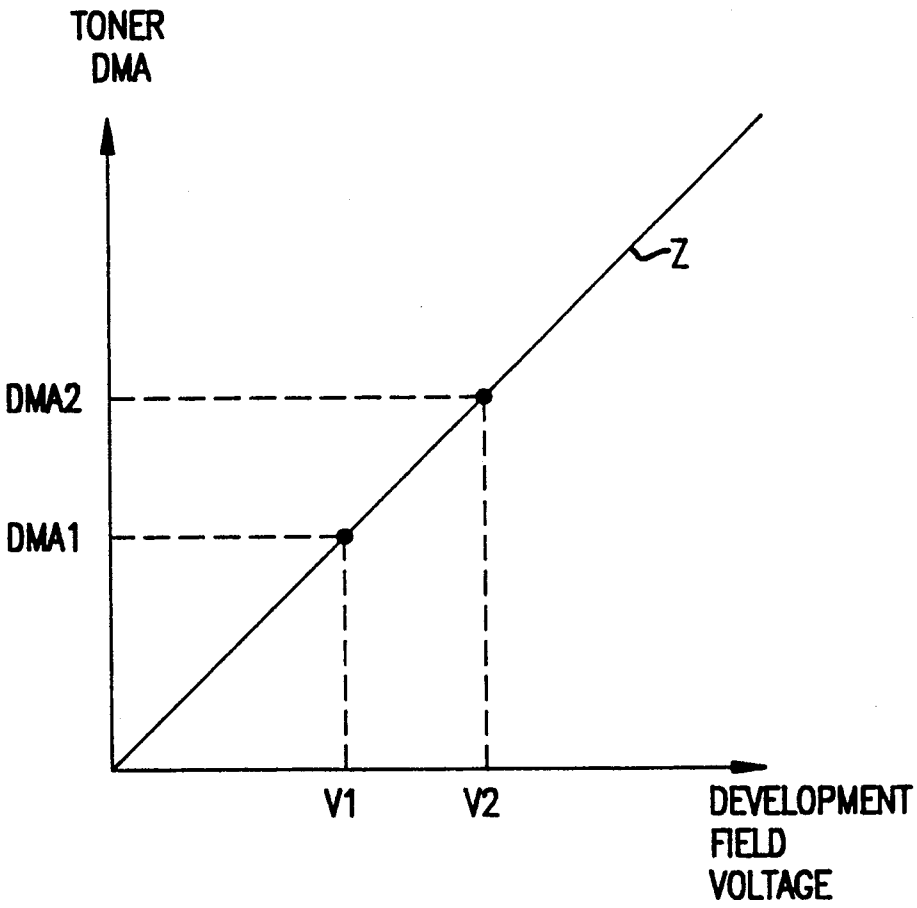
FIG. 3 is a graph plotting development field voltage vs. toner DMA.

FIG. 3 shows that as development field voltage increases from V1 to V2, the toner DMA on the electrostatic device increases from DMA1 to DMA2. The relationship between development field voltage and toner DMA is evident within a workable range of values for both parameters in a standard electrostatic imaging machine. Using a mapping, such as shown in FIG. 3, and the appropriate look-up table, the variation in voltage needed to effect the toner DMA may be determined. For example, if the calculated DMA is higher than the desired DMA, then from a look-up table, the proper development field for a desired DMA can be obtained. From FIG. 3, the voltage adjustment to obtain the necessary amount of toner to be deposited on the toner image at development station C (of the photocopying machine of FIG. 1) can be ascertained. The relationship between the development field and DMA will vary according to the characteristics of the particular toner, paper and electrostatic imaging machine used.

The invention resulted from the finding that density alone cannot be used to characterize the toner DMA on a print sheet since the density measurement is influenced by image gloss. Means 62 incorporates image gloss into its determination of DMA thus producing valid, accurate information even when changes in image gloss occur.

EXPERIMENTAL TESTS

The invention is based on comparing a derived DMA value with a desired DMA value for a particular toner, print sheet and electrostatic device then using the relationship between DMA, development field voltage and toner density to adjust the toner DMA accordingly. The best DMA equations and function tables derived therefrom, have been determined and experimentally verified for four standard toners on standard Textweb® paper. The toners used are typical cyan, magenta, yellow and black toners, so there is no reason to believe that less accurate results would occur using any other toners. Also, although only liquid toners were used in the following tests, the same characteristics of toner density, image gloss and toner developed mass per unit area, are applicable to toner powder.

The experiments empirically verify that DMA is a value which is functionally related to both toner density and image gloss. Thus, the results show that measuring toner density alone is insufficient for optimizing the readability and resolution of a print sheet in an electrostatic apparatus.

I. Definitions

The following definitions apply to the experiments that are described below unless otherwise modified.

Drawdown is defined as a technique used by toner chemists for providing a thin layer of toner on paper. An amount of toner is placed on the paper to be coated and spread out by pulling a circular wire wrapped rod down the length of the paper. This same technique is used in the paint and ink industries.

Textweb® paper is a standard paper manufactured by Champion Papers, Inc., Stamford, Conn.

C37 is an experimental label for a cyan liquid toner used in the reduction to practice of the invention. C37 is a standard cyan liquid toner which comprises 10% cyan pigment NBD 7010 manufactured by BASF Corp., Parsippany, N.Y., and the remainder is essentially Nucrel ® 599 manufactured by E. I. DuPont de Nemours and Company, Wilmington, Del.

Y30 is an experimental label for a yellow liquid toner used in the reduction to practice of the invention. Y30 is a standard yellow liquid toner which comprises 12% yellow pigment Diarylide ® pigment yellow 13 manufactured by Sun Chemical Corp., Cincinnati, Ohio, and the remainder is essentially Nucrel ® 599.

M15 is an experimental label for a magenta liquid toner used in the reduction to practice of the invention. M15 is a standard magenta liquid toner which comprises 8.8% Quindo ® red R6713, 16.3% Quindo ® red R6700 (both manufactured by Mobay Chemical Corp., Pittsburgh, Pa.), with the remainder essentially comprising Nucrel ® 599 and Pliotone ® 3002 manufactured by Goodyear, Inc., Akron, Ohio.

K27 is an experimental label for a black liquid toner used in the reduction to practice of the invention. K27 is a standard black liquid toner which comprises 18.6% Sterling ® NS carbon black manufactured by Cabot Corp., Boston, Mass., 0.4% cyan pigment NBD 7010, and the remainder essentially comprising Nucrel ® 599.

The methods for preparing the four liquid toners used in the experimental testing (C37, Y30, M15 and K27), are described in detail in U.S. Pat. Nos. 4,760,009, 4,670,370 and 4,923,778, which patents are herein incorporated by reference in their entirety.

MINITAB ® is a standard statistical analysis package which was used on a VAX computer system manufactured by Digital Equipment Corp (DEC), Maynard, Mass.

EXCEL ® is a standard spreadsheet manufactured by Microsoft, Inc., Redmond, Wash., which was used on a MacIntosh ® personal computer manufactured by Apple Computer Co., Cupertino, Calif.

A "DMA equation" is defined as an empirically derived mathematical relationship between toner density, image gloss and DMA that may be used for determining the developed toner mass per unit area for a given toner on a given paper.

An electrostatic "proofing machine" consisted of four consecutive stations each of which developed one color. Each station had an electrostatic master similar to that disclosed in U.S. Pat. No. 4,732,831 to Riesenfeld et al. The toner is developed on each master and then electrostatically transferred to paper, resulting in a four color image which is then fused in an oven-type fuser.

A "spectrophotometric" procedure uses light as a measuring tool to determine how much toner is on a sheet of paper i.e., the DMA. Those of ordinary skill in the art are familiar with spectrophotometric procedures based on the well known principle of Beer's Law.

A "gravimetrical" method for determining developed toner mass per unit area of toner fused onto a sheet of paper is defined as a method for removing the unfused toner from a known area of the sheet, evaporating all volatile components, such as the hydrocarbon fluid for a liquid toner system, and weighing the toner solids, thus yielding the weight of toner per square unit area.

II. DMA Determination

Determining DMA can be broken down into three phases. Phase I provides drawdowns of a particular toner on a particular paper stock. Phase II provides determination of toner density, image gloss and DMA for entry into a statistical analysis package. Phase III is the development of a function, or a look-up, table of toner density and DMA values for a given image gloss over a workable range of toner densities.

In the first phase of DMA determination, drawdowns of a toner of interest are obtained on an appropriate paper stock. Different DMA and gloss values are obtained by varying the wirewrapped drawdown rod wire diameter and fusing conditions, respectively. Also, measurement values and overall results vary according to the particular toner and paper used. A range of density and gloss levels is desired to define a region over which the means for determining DMA will be valid, i.e., a workable range. However, the upper and lower density and gloss values for the region should not differ greatly from those normally found in practice. Otherwise, the accuracy of the means for determining DMA will be diluted.

One drawdown method for developing DMA, gloss and density relationships for an electrostatic liquid toner is described below. The same or similar techniques can be easily performed by one of ordinary skill in the art, to determine DMA, gloss and density relationships for all toners used in an electrostatic device.

III. Procedures

One method used for developing the DMA equations is described hereinafter, relating values for gloss, density, and DMA, for four standard toners (C37, Y30, M15 and K27 as described above). Textweb ® paper is used and cut into pieces of approximately 60 mm×240 mm. A piece of paper was weighed in an aluminum pan to three decimal places (thousandths place) before making a drawdown, and the weight was recorded. The paper was not pre-wet, but was firmly placed under a clip with a piece of scrap paper beneath it. Cylindrical wirewrapped drawdown rods of various wire widths were used and designated as #8, #16 and #24. The #8 rod was put in place into a drawdown machine designed to spread liquid toner across a paper by pulling the #8 rod down the length of the paper. The toner was applied with a disposable pipet across the drawdown paper, making sure that toner goes beyond the edge on both sides, ensuring that the drawdown paper is fully covered by toner at all points. The drawdown was executed by pulling with a steady, even motion, and if streaking occurred, the rod was pulled at a slower rate. After making the drawdown, the weight of the wet drawdown paper was then measured in the aluminum pan and recorded. Next, the drawdown was immediately fused for 2 minutes or more at 125° C. The heating of the drawdown paper simulates the fusing process which occurs in an electrostatic device when a toner image is fused to a print sheet at a fusing station.

Another drawdown of a second piece of paper was performed using the same procedure as described above, again using a #8 cylindrical wirewrapped rod. The duplicative testing was to ensure accurate final results.

The same drawdown procedure described above was performed for two paper samples each using a #16 and a #24 rod. Also, the procedure described above was executed using each of the four toners (C37, M15, Y30 and K27). Each of the four sample toners then had six drawdowns each; two using the #8 rod, two using the #16 rod, and two using the #24 rod.

The oven was then reset to 100° C. for the M15 toner and three more drawdowns were performed for each rod. The drawdowns air dried for 20, 60 and 90 minutes respectively before fusing. The different periods of air drying varied the gloss of the fused image.

For C37, K27 and Y30 toners, the oven was reset to 90° C. and three more drawdowns were performed each according to the above procedure. One drawdown was fused immediately, one was air dried for 20 minutes and the other was air dried for 60 minutes before fusing. There were a total of 15 drawdowns for each of the four toners.

Next, toner density was measured using a MacBeth RD 918 densitometer manufactured by MacBeth Process Measurements, Newburgh, N.Y. Image gloss was measured using a Glossguard II glossmeter manufactured by Pacific Scientific, Gardner Division, Silver Spring, Md.

Six random gloss measurements were taken from each drawdown, three horizontally and three vertically, and an average gloss measurement was determined. The average toner density was derived from ten random density measurements from each drawdown, three density measurements from near each edge and four down the center from the top to bottom. The drawdown area was obtained by measuring the length and width of each drawdown.

In order to determine the DMA for each drawdown in mg/cm$^2$ where the DMA equals the mass of dry toner per area covered and the mass of the dry toner equals the percentage of solids of the wet toner times the mass of the wet toner divided by 100; the weight of the aluminum pan and dry paper in grams was subtracted from the weight of the aluminum pan and wet drawdown paper in grams multiplying that quantity times 1000 (to determine mg) times the % solids of the toner divided by 100, and dividing the whole quantity thus far calculated by the surface area of the paper in square centimeters.

In the second phase of DMA determination, a set of equations for determining the DMA as related to image gloss and toner density, was determined for the gloss and density measurements taken, using a standard statistical analysis package, MINITAB®. The drawdown data was entered into the program in column form and then fit using linear regression to obtain a "best DMA equation" relating toner density, image gloss and DMA for a particular print sheet using a particular toner.

The DMA equations correlating to the means for determining DMA for the toner set tested were empirically and statistically derived as:

C37:
$$\text{Density} = -0.219 + 11.3(\text{DMA}) + 0.00202(\text{Gloss}) - 19.4(\text{DMA})^2$$

M15:
$$\text{Density} = -0.152 + 9.23(\text{DMA}) + 0.0102(\text{Gloss}) - 16.4(\text{DMA})^2$$

Y30:
$$\text{Density} = 0.167 + 8.77(\text{DMA}) + 0.000144(\text{Gloss})^2 - 18.2(\text{DMA})^2$$

K27:
$$\text{Density} = -0.582 + 15.8(\text{DMA}) + 0.00948(\text{Gloss}) - 33.2(\text{DMA})^2$$

Following is a sample MINITAB® program input for determining a best DMA equation for K27 toner and Textweb® paper. The measured values for density, gloss and DMA were used by MINITAB® to calculate DMA$^2$, Gloss$^2$ and DMA*Gloss.

Sample MINITAB © Output for K27

| ROW | DENSITY | DMA | GLOSS | DMA$^2$ | GLOSS$^2$ | DMA* GLOSS |
|---|---|---|---|---|---|---|
| 1 | 1.021 | 0.103 | 42.6 | 0.010609 | 1814.76 | 4.3878 |
| 2 | 0.923 | 0.089 | 43.4 | 0.007921 | 1883.56 | 3.8626 |
| 3 | 1.016 | 0.092 | 49.8 | 0.008464 | 2480.04 | 4.5816 |
| 4 | 1.015 | 0.100 | 35.0 | 0.010000 | 1225.00 | 3.5000 |
| 5 | 0.887 | 0.090 | 32.2 | 0.008100 | 1036.84 | 2.8980 |
| 6 | 1.869 | 0.206 | 64.6 | 0.042436 | 4173.16 | 13.3076 |
| 7 | 1.760 | 0.174 | 57.9 | 0.030276 | 3352.41 | 10.0746 |
| 8 | 1.519 | 0.150 | 53.5 | 0.022500 | 2862.25 | 8.0250 |
| 9 | 1.782 | 0.199 | 49.2 | 0.039601 | 2420.64 | 9.7908 |
| 10 | 1.732 | 0.193 | 50.7 | 0.037249 | 2570.49 | 9.7851 |
| 11 | 1.939 | 0.263 | 71.1 | 0.069169 | 5055.21 | 18.6993 |
| 12 | 1.938 | 0.247 | 65.9 | 0.061009 | 4342.81 | 16.2773 |
| 13 | 1.786 | 0.238 | 57.5 | 0.056644 | 3306.25 | 13.6850 |
| 14 | 1.830 | 0.241 | 59.9 | 0.058081 | 3588.01 | 14.4359 |
| 15 | 1.292 | 0.269 | 2.6 | 0.072361 | 6.76 | 0.6994 |
| 16 | 1.206 | 0.191 | 2.6 | 0.036481 | 6.76 | 0.4966 |
| 17 | 1.183 | 0.171 | 6.2 | 0.029241 | 38.44 | 1.0602 |
| 18 | 1.181 | 0.181 | 6.8 | 0.032761 | 46.24 | 1.2308 |
| 19 | 0.917 | 0.099 | 13.1 | 0.009801 | 171.61 | 1.2969 |

The MINITAB® program used the information from the above table to determine the best functional relationship between density and the other parameters. In this case, the best fit was the fifth regression.

Sample MINITAB © Output for K27
Best Subsets Regression of DENSITY

| Vars | R-sq | DMA | GLOSS | DMA$^2$ | GLOSS$^2$ | DMA* GLOSS |
|---|---|---|---|---|---|---|
| 1 | 78.8 | | | | | X |
| 1 | 64.8 | X | | | | |
| 2 | 91.3 | X | X | | | |
| 2 | 91.1 | X | | | | X |
| 3 | 98.3 | X | X | X | | |
| 3 | 97.7 | X | | X | | X |
| 4 | 98.4 | X | X | X | | X |
| 4 | 98.3 | X | X | X | X | |
| 5 | 98.5 | X | X | X | X | X |

R-sq is defined as a correlation coefficient, which varied according to the parameters used by MINITAB® to calculate a best DMA equation. A three variable best DMA equation (using DMA, gloss and DMA$^2$) was arbitrarily chosen for each of the tests described herein, where the correlation coefficient was determined above as 98.3.

In the step illustrated by the following sample MINITAB® output, the command REGRESS was used to determine the variables associated with the best regression.

The regression equation is:

$$DENSITY = -0.582 + 15.8DMA + 0.00948\text{-}GLOSS - 33.2DMA^2.$$

In the third phase of DMA determination, the best DMA equation was put into a standard spreadsheet, EXCEL®, for easy use. After measuring image density and gloss on the sample, the average gloss and a starting value for DMA were entered into the spreadsheet. The EXCEL® program automatically stepped up the DMA at intervals of 0.002 mg/cm$^2$ from the starting value and determined a density for each DMA value using the entered gloss. A workable density range for a given gloss was considered. Example spreadsheets follow for each of the liquids toners tested on Textweb® paper.

TABLE 1

STATISTICAL SPREADSHEET DATA FOR DETERMINING DMA USING C37 TONER ON TEXTWEB ® PAPER
ENTER GLOSS: 45
ENTER STARTING DMA (LOW POINT): 0.12

| DENSITY | DMA | GLOSS |
|---|---|---|
| 0.96 | 0.120 | 45.0 |
| 0.97 | 0.122 | |
| 0.99 | 0.124 | |
| 1.00 | 0.126 | |
| 1.01 | 0.128 | |
| 1.03 | 0.130 | |
| 1.04 | 0.132 | |
| 1.05 | 0.134 | |
| 1.06 | 0.136 | |
| 1.08 | 0.138 | |
| 1.09 | 0.140 | |
| 1.10 | 0.142 | |
| 1.11 | 0.144 | |
| 1.12 | 0.146 | |
| 1.14 | 0.148 | |
| 1.15 | 0.150 | |
| 1.16 | 0.152 | |
| 1.17 | 0.154 | |
| 1.18 | 0.156 | |
| 1.19 | 0.158 | |
| 1.20 | 0.160 | |
| 1.21 | 0.162 | |
| 1.22 | 0.164 | |
| 1.23 | 0.166 | |
| 1.24 | 0.168 | |
| 1.25 | 0.170 | |

DENSITY RANGE: 0.69–1.59
GLOSS RANGE: 44.7–74.6

TABLE 2

STATISTICAL SPREADSHEET DATA FOR DETERMINING DMA USING M15 TONER ON TEXTWEB ® PAPER
ENTER GLOSS: 45
ENTER STARTING DMA (LOW POINT): 0.13

| DENSITY | DMA | GLOSS |
|---|---|---|
| 1.23 | 0.130 | 45.0 |
| 1.24 | 0.132 | |
| 1.25 | 0.134 | |
| 1.26 | 0.136 | |
| 1.27 | 0.138 | |
| 1.28 | 0.140 | |
| 1.29 | 0.142 | |
| 1.30 | 0.144 | |
| 1.30 | 0.146 | |
| 1.31 | 0.148 | |
| 1.32 | 0.150 | |
| 1.33 | 0.152 | |
| 1.34 | 0.154 | |
| 1.35 | 0.156 | |
| 1.36 | 0.158 | |
| 1.36 | 0.160 | |
| 1.37 | 0.162 | |
| 1.38 | 0.164 | |
| 1.39 | 0.166 | |
| 1.39 | 0.168 | |
| 1.40 | 0.170 | |
| 1.41 | 0.172 | |
| 1.42 | 0.174 | |
| 1.42 | 0.176 | |
| 1.43 | 0.178 | |
| 1.44 | 0.180 | |

DENSITY RANGE: 0.62–1.62
GLOSS RANGE: 4.58–47.5

TABLE 3

STATISTICAL SPREADSHEET DATA FOR DETERMINING DMA USING Y30 TONER ON TEXTWEB ® PAPER
ENTER GLOSS: 45
ENTER STARTING DMA (LOW POINT): 0.08

| DENSITY | DMA | GLOSS |
|---|---|---|
| 1.04 | 0.080 | 45.0 |

TABLE 3-continued

STATISTICAL SPREADSHEET DATA FOR DETERMINING DMA USING Y30 TONER ON TEXTWEB ® PAPER
ENTER GLOSS: 45
ENTER STARTING DMA (LOW POINT): 0.08

| DENSITY | DMA | GLOSS |
|---|---|---|
| 1.06 | 0.082 | |
| 1.07 | 0.084 | |
| 1.08 | 0.086 | |
| 1.09 | 0.088 | |
| 1.10 | 0.090 | |
| 1.11 | 0.092 | |
| 1.12 | 0.094 | |
| 1.13 | 0.096 | |
| 1.14 | 0.098 | |
| 1.15 | 0.100 | |
| 1.16 | 0.102 | |
| 1.17 | 0.104 | |
| 1.18 | 0.106 | |
| 1.19 | 0.108 | |
| 1.20 | 0.110 | |
| 1.21 | 0.112 | |
| 1.22 | 0.114 | |
| 1.23 | 0.116 | |
| 1.24 | 0.118 | |
| 1.25 | 0.120 | |
| 1.26 | 0.122 | |
| 1.27 | 0.124 | |
| 1.27 | 0.126 | |
| 1.28 | 0.128 | |
| 1.29 | 0.130 | |

DENSITY RANGE: 0.904–1.658
GLOSS RANGE: 25.9–56.0

TABLE 4

STATISTICAL SPREADSHEET DATA FOR DETERMINING DMA USING K27 TONER ON TEXTWEB ® PAPER
ENTER GLOSS: 45
ENTER STARTING DMA (LOW POINT): 0.1

| DENSITY | DMA | GLOSS |
|---|---|---|
| 1.09 | 0.100 | 45.0 |
| 1.11 | 0.102 | |
| 1.13 | 0.104 | |
| 1.15 | 0.106 | |
| 1.16 | 0.108 | |
| 1.18 | 0.110 | |
| 1.20 | 0.112 | |
| 1.21 | 0.114 | |
| 1.23 | 0.116 | |
| 1.25 | 0.118 | |
| 1.26 | 0.120 | |
| 1.28 | 0.122 | |
| 1.29 | 0.124 | |
| 1.31 | 0.126 | |
| 1.32 | 0.128 | |
| 1.34 | 0.130 | |
| 1.35 | 0.132 | |
| 1.37 | 0.134 | |
| 1.38 | 0.136 | |
| 1.39 | 0.138 | |
| 1.41 | 0.140 | |
| 1.42 | 0.142 | |
| 1.43 | 0.144 | |
| 1.44 | 0.146 | |
| 1.46 | 0.148 | |
| 1.47 | 0.150 | |

DENSITY RANGE: 0.89–1.94
GLOSS RANGE: 2.6–71.1

IV. Verification of Empirical Results

Several different experiments were performed to assess the accuracy of the previously described experiments for empirically deriving DMA equations where comparisons were made to samples for which the DMA is actually known and to samples for which the DMA is not known.

The simplest test uses the above DMA results to predict the DMA of a known sample. This test was performed using C25 toner, a cyan toner similar to C37, on Textweb® paper. Twenty-five drawdowns were used to generate a table of C25 DMA values for a specific range. The table was then used to predict the DMA for twelve new drawdowns of C25 on Textweb® paper. The DMA for each new drawdown was determined gravimetrically and compared to the predicted values. The results of the comparison are shown in Table 5. This analysis indicates that the C25 DMA predictions were accurate to at least within 10%. Since C25 is a standard toner, there is ample justification for assuming that other standard toners would provide similarly accurate results. The results of experiments to be described hereinafter will show that this assumption is sound.

The DMA equation for C25 toner on Textweb® paper is:

TABLE 5

Comparison of actual to predicted DMA for C25 on Textweb® paper. DMA values are given in the units of mg/cm$^2$.
C25: Density = $-0.119 + 10.1\,(DMA) + 0.0309\,(DMA)\,(Gloss) - 21.7\,(DMA)^2$

| Measured Values | | | Predicted | % Difference in |
|---|---|---|---|---|
| DMA | Gloss | Density | DMA | DMA Values |
| 0.174 | 54.2 | 1.30 | 0.181 | 4.2 |
| 0.154 | 54.1 | 1.25 | 0.169 | 10.0 |
| 0.171 | 55.6 | 1.30 | 0.179 | 4.9 |
| 0.163 | 56.1 | 1.26 | 0.169 | 3.8 |
| 0.150 | 50.8 | 1.20 | 0.162 | 8.0 |
| 0.157 | 61.2 | 1.20 | 0.152 | 3.2 |
| 0.162 | 52.9 | 1.13 | 0.146 | 9.8 |
| 0.157 | 61.4 | 1.20 | 0.152 | 3.3 |
| 0.159 | 55.1 | 1.20 | 0.158 | 0.9 |
| 0.135 | 60.5 | 1.08 | 0.132 | 2.4 |
| 0.143 | 54.4 | 1.13 | 0.145 | 1.3 |
| 0.151 | 53.4 | 1.22 | 0.164 | 8.3 |

The next step in the verification was to compare the empirically determined DMA values to actual liquid toner prints. The image is the gloss target, which consists of $2\frac{1}{2}'' \times 2\frac{1}{2}''$ squares of solid colors. A total of eight alternately fused and unfused prints from a prototype proofing machine were used in the analysis. The prototype proofing machine was operating under standard domestic conditions. The fused images were used with the appropriate DMA equation to predict DMA. The DMA of the unfused prints were determined by ultraviolet visible spectrophotometry, i.e., UV/Vis spectrophotometry.

The spectrophotometric procedure involves a number of steps for using light as a measuring tool to determine how much toner is on a sheet of paper. Any colloidal dispersion, such as liquid toner, will attenuate light by scattering and absorption. The amount of light attenuated will increase as the concentration of the dispersion increases with everything else being equal. Thus, a calibration curve can be derived with known concentrations of toner against the light attenuation determined with a spectrophotometric measuring device.

First, the toner was washed from the fused paper using a known amount of dilute Basic Barium Petronate® solution. Basic Barium Petronate® is manufactured by Witco Corp., N.Y., N.Y. The UV/Vis spectrum of the sample was obtained and the level of attenuation determined and compared to the previously constructed calibration curve. From the curve, the concentration of toner and thus the amount of toner in the unknown sample was determined. Finally, the amount of toner for a known sample area allowed direct determination of DMA. The results of this analysis are shown in Table 6.

TABLE 6

Comparison of measured to predicted DMA for liquid toners on Textweb® paper. A total of eight alternately fused and unfused prints from the prototype proofing machine were used in the analysis. DMA values are given in the units of mg/cm$^2$.

| Toner | Measured DMA | Predicted DMA |
|---|---|---|
| M15 | 0.127 ± 0.003 | 0.126 ± 0.004 |
| K27 | 0.090 ± 0.003 | 0.100 ± 0.001 |

The results of the above described experiment were good. The determination of DMA for M15 toner provided the most accurate results, where the measured and predicted DMA values were almost identical. The determination of DMA for K27 toner also was accurate by predicting the DMA to within the assigned accuracy limit of 10%.

In the next set of experiments, the DMA equations for different batches of toners K27 and Y30 were used to empirically derive DMA values which were then compared to two known methods of accurately determining DMA: UV/Vis spectrophotometry and gravimetric analysis. The purpose of this work was to further confirm the validity of the previous empirically determined DMA results.

Experiments were performed on a machine which emulated a electrophotographic copying machine, using K27 and Y30 toners and Textweb® paper with prewet. The test image consisted of $2\frac{1}{2}'' \times 2\frac{1}{2}''$ solid squares. Alternate prints were selected for each measurement method. At the end of each run, the master was toned, removed from the machine and the DMA determined both spectroscopically and gravimetrically. Table 7 summarizes the results for K27 toner and Table 8 summarizes the results for Y30 toner.

TABLE 7

A comparison of the DMA measurements for K27. DMA is given in mg/cm$^2$.
K27 Comparison
Solids

| Print | DMA | Method |
|---|---|---|
| #5 | 0.106 | UV/Vis |
| #6 | 0.109 | Grav. (a) |
| #7 | 0.122 | DMA Calc. |
| Master #1 | 0.101 | UV/Vis |
| #8 | 0.101 | UV/Vis |
| #9 | 0.079 | Grav. (a) |
| #10 | 0.114 | DMA Calc. |
| Master #2 | 0.074 | Grav. (b) |
| #11 | 0.100 | UV/Vis |
| #12 | 0.082 | Grav. (a) |
| #13 | 0.108 | DMA Calc. |
| Master #3 | 0.112 | UV/Vis |
| #14 | 0.092 | UV/Vis |
| #15 | 0.094 | Grav. (a) |
| #16 | 0.103 | DMA Calc. |
| Master #4 | 0.079 | Grav. (a) |

NOTES:
(a) Appreciable toner lost during removal from substrate.
(b) Sample spilled.

TABLE 8

A comparison of the Y30 DMA measurements. DMA is given in the units of mg/cm$^2$.

| Y30 Comparison Solids | | |
|---|---|---|
| Print | DMA | Method |
| #5 | 0.141 | Grav. (a) |
| #6 | 0.161 | UV/Vis |
| #7 | 0.178 | DMA Calc. |
| Master #1 | 0.149 | Grav. (a) |
| #8 | 0.166 | Grav. (a) |
| #9 | 0.180 | UV/Vis |
| #10 | 0.194 | DMA Calc. |
| Master #2 | 0.196 | UV/Vis |
| #11 | 0.169 | Grav. (a) |
| #12 | 0.191 | UV/Vis |
| #13 | 0.198 | DMA Calc. |
| Master #3 | 0.179 | Grav. (a) |
| #14 | 0.151 | Grav. (a) |
| #15 | 0.176 | UV/Vis |
| #16 | 0.192 | DMA Calc. |
| Master #4 | 0.190 | UV/Vis |
| After Air Drying | | |
| #17 | 0.184 | UV/Vis |
| #18 | 0.188 | UV/Vis |
| Master #5 | 0.103 | UV/Vis |

NOTES:
(a) Appreciable toner lost during removal from substrate.

The UV/Vis spectrophotometric technique requires scraping toner from the substrate and suspending this toner in Basic Barium Petronate® solution. The toner should be suspended in the solution as soon as possible. Past work, in which the toned samples were allowed to air dry somewhat, gave mixed results. Air drying seems to especially effect the toned master samples. Drying evidently interferes with the spectrophotometric technique.

Gravimetric determination of DMA provides an accurate measurement of the amount of toner by weight on a print sheet. Specifically, gravimetric determination of DMA requires washing of the toner into a tared receiving dish using a solvent which then evaporates cleanly. In this experiment, 1,1,2-trichlorotrifluoroethane was used as a solvent and it was necessary to scrub the images off the substrate with a cotton-tipped swab.

The determination of DMA using the methods described corroborated the UV/Vis results considering the assigned 10% accuracy level and the variability of the photocopier emulating machine. The test results support the 10% accuracy level assigned to the determination of DMA in the C25 experiment.

V. Conclusion

The experimental tests and results described herein confirm the applicants' finding that toner developed mass per unit area (DMA) can be calculated by image density and gloss measurements to allow for adjustment of the DMA within the electrostatic device. Previous methods and apparatus have not recognized, suggested, or utilized the effect that image gloss has on the toner density required for optimum readability of a fused toner image.

The DMA values predicted by using a best DMA equation for a particular toner and paper, or a function table derived therefrom, have been proven to fall within an acceptable margin of error for the standard toners tested. Thus, the empirical results confirm the development and use of the best DMA equation for a given toner on a given paper within acceptable limits. The comparison of an required DMA value to a derived DMA value, calculated from contemporaneous density and gloss measurements on an electrostatic apparatus, can be used in any of numerous electrostatic devices, such as a photocopy machine, to produce an image with a required DMA for an optimum quality print. The DMA calculated from density and gloss measurements on the final print can be used to allow control of all three parameters, DMA, glass, and density, to provide a print sheet of optimum readability, resolution, solid area coverage, print density, and print gloss.

What is claimed is:

1. A method for controlling toner developed mass per unit area in an electrostatic apparatus comprising the steps of:

fusing a toner image on a printing sheet;

measuring a toner density of the toner image on the printing sheet;

measuring a gloss of the toner image on the printing sheet;

determining a toner developed mass per unit area for the measured gloss and measured toner density; and adjusting the development field in the electrostatic device in accordance with the determined toner developed mass per unit area.

2. The method as claimed in claim 1, in which the step of adjusting the developed toner mass per unit area includes adjusting a voltage of a development field in a range in which the toner developed mass per unit area and the voltage of the development field are related, so that an increase in the voltage leads to an increase in the toner developed mass per unit area, and a decrease in the voltage leads to a decrease in the toner developed mass per unit area.

3. The method as claimed in claim 1, in which the step of measuring the toner density includes measuring the toner density with a reflectance densitometer.

4. The method as claimed in claim 1, in which the step of measuring the gloss includes measuring the gloss with a glossmeter.

5. The method as claimed in claim 1, in which a liquid toner is used for fusing the toner image, said liquid toner being workable with the electrostatic apparatus.

6. The method as claimed in claim 1, in which a toner powder is used for fusing the toner image, said toner powder being workable with the electrostatic apparatus.

7. The method as claimed in claim 1, in which the printing sheet is a type of printing sheet workable with the electrostatic apparatus.

8. The method as claimed in claim 7, in which the printing sheet is standard paper.

9. An apparatus for controlling toner developed mass per unit area in an electrostatic device comprising:

means for fusing a toner image onto a printing sheet;

means for measuring a toner density of toner particles on the fused toner image;

means for measuring a gloss of the fused toner image on the printing sheet;

means for determining a toner developed mass per unit area for the measured gloss and measured toner density; and means for adjusting a voltage of a development field in a range in which the toner developed mass per unit area and the voltage of the development field are related, so that an increase in the voltage leads to an increase in the toner developed mass per unit area, and a decrease in the voltage leads to a decrease in the toner developed mass per unit area.

10. The apparatus as claimed in claim 9, wherein the means for fusing a toner image includes means for fusing a toner image comprising a liquid toner being workable with the electrostatic device.

11. The apparatus as claimed in claim 9, wherein the means for fusing a toner image includes means for fusing a toner image comprising a toner powder being workable with the electrostatic device.

12. The apparatus as claimed in claim 9, wherein the printing sheet is Textweb® paper.

13. The method as claimed in claim in which a transfer efficiency is at least 95% for a toner that is transferred to a final print sheet.

* * * * *